US005675209A

United States Patent [19]

Hall, Jr. et al.

[11] Patent Number: 5,675,209

[45] Date of Patent: Oct. 7, 1997

[54] ELECTRODE MATERIAL FOR A SPARK PLUG

[75] Inventors: Bertie Forrest Hall, Jr., Ann Arbor; Phillip D. Brackman, Whitmore Lake, both of Mich.

[73] Assignee: Hoskins Manufacturing Company, Detroit, Mich.

[21] Appl. No.: 491,618

[22] Filed: Jun. 19, 1995

[51] Int. Cl.[6] ..... H01T 1/24; H01B 1/06

[52] U.S. Cl. ..... 313/141; 313/131 A; 313/144

[58] Field of Search ..... 313/141, 142, 313/144, 493, 633, 130, 131 A, 138; 723/169 EL

[56] References Cited

U.S. PATENT DOCUMENTS

| | | | |
|---|---|---|---|
| 3,356,882 | 12/1967 | Hallauer et al. | 313/141 |
| 3,548,472 | 12/1970 | Urushiwara et al. | 313/141 X |
| 3,818,555 | 6/1974 | Yamaguchi et al. | 313/141 X |
| 3,984,717 | 10/1976 | Romanowski et al. | 313/141 |
| 4,725,254 | 2/1988 | Moore et al. | 313/141 X |
| 4,803,395 | 2/1989 | Matesco | 313/141 |
| 4,808,135 | 2/1989 | Sakura et al. | 313/141 X |
| 4,881,913 | 11/1989 | Mann | 445/7 |
| 4,904,216 | 2/1990 | Kagawa et al. | 445/7 |
| 5,210,457 | 5/1993 | Oshima et al. | 313/11.5 |
| 5,273,474 | 12/1993 | Oshima et al. | 445/7 |
| 5,320,569 | 6/1994 | Oshima et al. | 445/7 |
| 5,347,193 | 9/1994 | Oshima et al. | 313/141 |
| 5,369,328 | 11/1994 | Gruber et al. | 313/141 |
| 5,373,214 | 12/1994 | McCready | 313/142 |
| 5,395,273 | 3/1995 | Matsutani | 445/7 |
| 5,440,198 | 8/1995 | Oshima et al. | 313/141 |
| 5,461,276 | 10/1995 | Matsutani et al. | 313/141 |

*Primary Examiner*—Ashok Patel
*Attorney, Agent, or Firm*—Brooks & Kushman P.C.

[57] ABSTRACT

An electrode material for a spark plug 10 for use in an internal combustion engine. The electrode material includes a core 20 having a high thermal conductivity for reducing the temperature of the spark plug 10 by thermally conducting heat away from the spark plug gap to a cooler part of the engine. The core 20 extends continuously from an arcing surface at an end of a spark plug electrode to the cooler part of the engine. Surrounding the core 20 is a cladding layer 22 for resisting corrosion when exposed to high temperatures caused by arcing.

22 Claims, 2 Drawing Sheets

ELECTRODE MATERIAL FOR A SPARK PLUG

TECHNICAL FIELD

This invention relates to an electrode material for a spark plug used in an internal combustion engine.

BACKGROUND ART

A spark plug is sometimes cited as a limiting factor of engine performance. With more sophisticated ignition and fuel delivery systems, an otherwise unchanged internal combustion engine can realize significant gains in power, smoothness, and reliability if spark plug technology is able to keep abreast.

Modern automobiles employ computers to manage ignition and fuel-injection systems. Today's cars have the highest specific output, greatest overall efficiency, and lowest emissions in history. Nevertheless, there remains a quest for ignition systems which will operate efficiently and consistently for over 100,000 miles before service is required. Spark plugs are the major obstacle to meeting this objective. Erosion of the surfaces between which arcing takes place gradually causes the spacing, or spark gap, to increase. This causes a reduction in the effectiveness of the spark in initiating complete combustion. Power loss occurs and emissions of unburned hydrocarbons increase. This particularly occurs when the engine operating conditions are at the extreme temperatures of hot and cold.

It is well documented that the heat generated by the spark and the subsequent, burning of the fuel causes very elevated temperatures to be maintained at the spark electrode surfaces. Material is eroded progressively more vigorously as the temperature rises to higher levels. Accordingly, it would be desirable to reduce this temperature, and to remove the heat generated by the arc and fuel combustion as it affects the temperature of the spark electrodes.

Ideally, it would be desirable to engineer a spark plug with electrode materials so that gap integrity can be maintained.

Conventionally, automotive spark plugs are manufactured with a center electrode made of a nickel alloy with a core of copper to conduct heat generated by the ignition spark and fuel combustion from the electrode tip. The objective is to reduce the temperature at the electrode arcing surface, reducing erosion, and prolonging the life of the spark plug.

Extrusion of copper and the nickel alloys simultaneously in the fabrication process results in a copper-cored rectangular cross-section electrode that when welded to the steel shell of the spark plug provides some reduction in operating temperatures.

Such electrodes are only produced with about 30% copper by weight. The flow characteristics of the copper and the nickel alloy cladding differ greatly in the co-extrusion process. The copper does not maintain a uniform cross-section. To increase the amount of copper over about 30% would increase the risk of thinning the cladding to the point of rupture of the cladding during fabrication. Copper, if exposed to the engine atmosphere, can be oxidized and the low density oxide particles will have poor adherence to the base metal and spall due to differential thermal expansion as heating and cooling take place. These particles in the cylinder of the engine could cause mechanical damage to piston rings and other components.

Traditionally, copper-containing electrodes are manufactured individually. Each electrode must be trimmed and welded to the spark plug shell or center stem. Productivity is less than in the fabrication of spark plugs with solid electrodes which are welded in automatic machines that do not require individual handling.

In the extrusion of the copper and nickel alloy together, there often results a non-uniform cross-section of the copper core and a lack of metallurgical bonding between the member constituents. Frequently, voids and other flaws are manifest in individually produced composite electrodes. These voids and flaws interfere with heat flow and diminish the effectiveness of the high conductivity copper core.

SUMMARY OF THE INVENTION

A solution to the difficulties presented by conventional approaches calls for a cladding technique to cover a large nickel or other high conductivity core material with a formed and welded strip of nickel alloy selected for use as the electrode surface. This results in a coil of composite wire with a core of about 70% of the wire cross-section being nickel or other suitable material with a high thermal conductivity.

The composite wire can be processed on equipment currently used to fabricate solid alloy spark plug electrodes including equipment and techniques for continued manufacture of finished spark plugs by conventional methods.

The present invention permits electrodes to be made with round, rectangular, and other shaped cross-sections.

It is an object of the present invention to provide an electrode material for a spark plug which has a durable core having a high thermal conductivity for reducing the operating temperature of the spark plug by conducting heat away from the spark plug gap.

Accordingly, the present invention discloses an electrode material for a spark plug. Conventionally, the spark plug has a center electrode, and a ground electrode, between which a gap is defined. The ground electrode is traditionally joined to a steel shell, the average temperature of which will be lower than the temperature in the gap region where the spark is formed prior to fuel detonation.

The electrode material comprises a core having a high thermal conductivity. The core is able to reduce the temperature of the spark plug by thermally conducting heat away from the gap to the engine block by way of the spark plug shell to which it is welded. Surrounding the core is a cladding layer of a nickel-base alloy for resisting erosion when exposed to the high temperatures caused by arcing and combustion of fuel. The metallic core extends continuously from an arcing surface at an end of the electrodes to the cooler part of the spark plug.

BEST MODE FOR CARRYING OUT THE INVENTION

Figure 1:
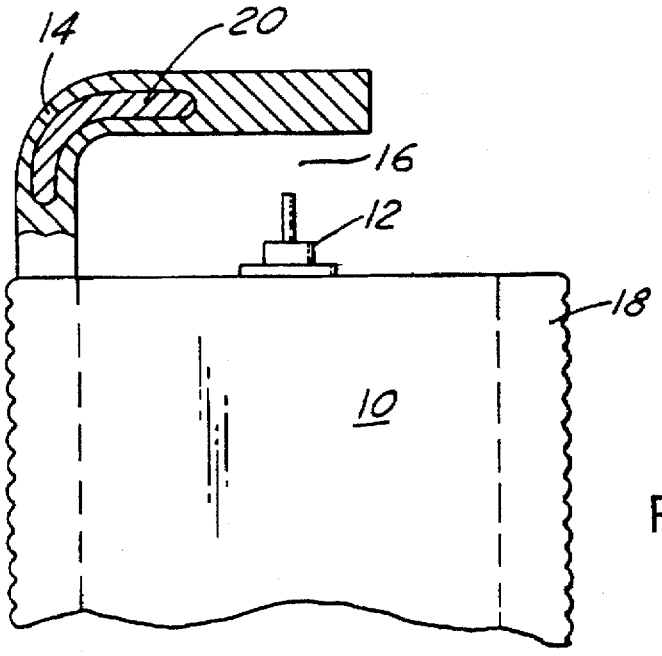
FIG. 1 PRIOR ART
FIG. 1 is a cross-sectional view of a spark plug material found in the prior art.
Figure 2:
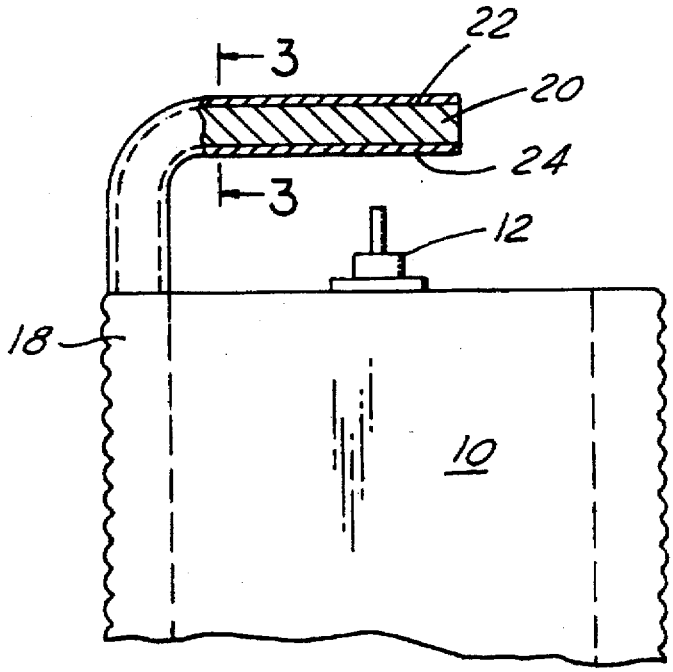
FIG. 2 is a cross-sectional view of an operating section of a spark plug for use in an internal combustion engine.

Turning first to FIGS. 1–2, there is depicted a cross-sectional view of a conventional spark plug 10 for use in an internal combustion engine. The spark plug 10 conventionally has a central electrode 12, a ground electrode 14, and a gap 16 defined therebetween. Traditionally, the ground electrode is joined by welding, to a cooler part of the spark plug such as steel shell 18.

In FIG. 1, there is depicted a composite spark plug electrode found in the prior art which includes a section having a high thermal conductivity. Such a construction is often typified by erosion which is manifest after prolonged exposure to the operating environment of an internal combustion engine.

Figure 3:
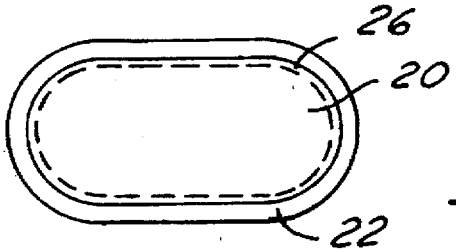
FIG. 3 is a cross-sectional view of an electrode of the present invention taken along the line 3—3 of FIG. 2.
Figure 4:
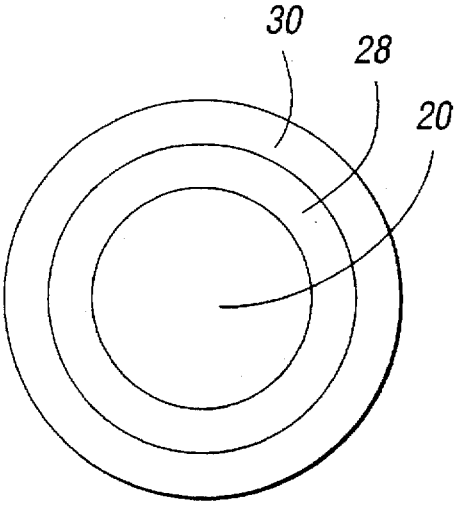
FIG. 4 is a cross-sectional view of an electrode of the present invention illustrating multi-layers surrounding the core.

Turning now to FIGS. 2–3 of the drawings, there is depicted a metallic core 20 which has a high thermal conductivity that is helpful in reducing the temperature of the spark plug by conducting heat away from the gap 16 to a cooler part, such as steel shell 18 of the spark plug. Surrounding the core 20 is a cladding layer of a nickel-base alloy layer 22. The cladding layer 22 resists erosion when exposed to the high temperatures caused by arcing and combustion of the fuel. As best shown in FIG. 2, the metallic core extends continuously from an arcing surface 24 located at the end of the electrode to the cooler part of the engine through the steel shell 18 of the spark plug.

The electrode material of the present invention provides an enhanced heat conducting capacity over conventional copper-cored electrodes since much more core material can be used and less thickness of low conductivity cladding alloy is required. Thus, a much greater proportion of the cross-section than is found in the prior art can be devoted to heat conduction.

Turning now to FIG. 3, there is depicted a diffusion interlayer 26 between the core 20 and cladding layer 22. The diffusion interlayer 26 serves as a metallurgical bond which enhances heat transfer and minimizes delamination of the cladding from the core. The nickel alloy cladding has a minimal effect on heat flow since the core is metallurgically bonded to the cladding along the length of the electrode and proximate the arcing surface.

Suitable materials for the core besides copper include high purity nickel, which has been found to improve the electrode life of a conventional copper-cored extruded electrode. High purity nickel can be exposed to the engine atmosphere with no harmful effects. Additionally, nickel cores tend to enhance the welding of the ground electrode to the shell in relation to the weldability of solid nickel alloy electrodes.

If desired, the sheath thickness can be varied to change the effective thickness of the electrode wear surface in order to promote longevity of the resulting spark plug.

The technology disclosed herein can be used to fabricate either the ground electrode or the center electrode or both. Such approaches can be expected to greatly extend service life, given an appropriate selection of sheathing, closure technique, and filler metals.

Figure 5:
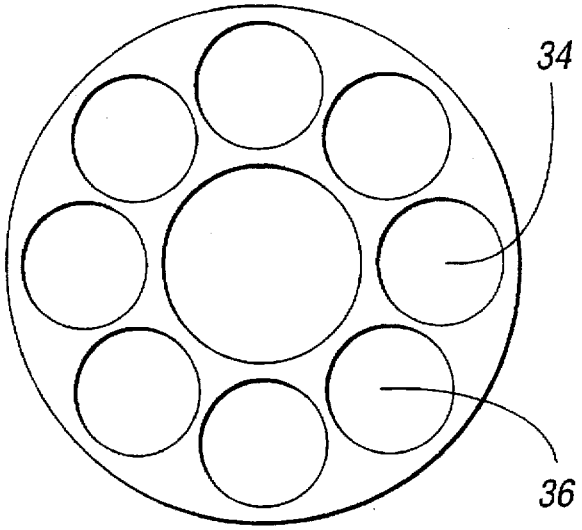
FIG. 5 depicts a cross-sectional view of an alternate embodiment of an electrode of the present invention, including a stranded structure.
Figure 6:
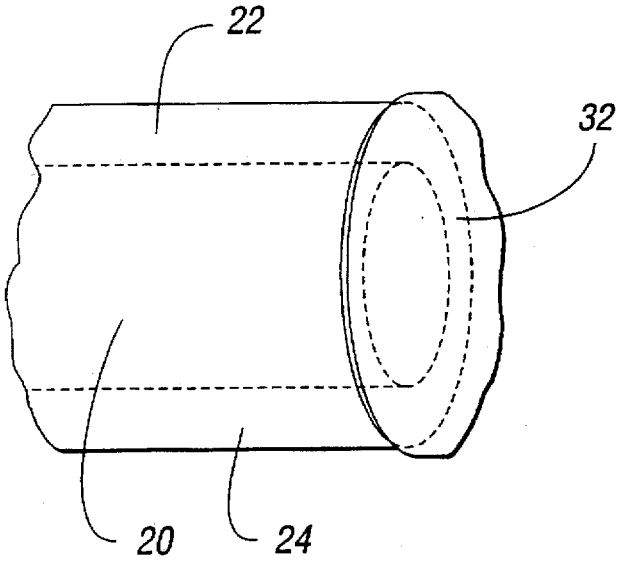
FIG. 6 is an enlarged perspective view of a portion of FIG. 2 illustrating the cap 32 with the core 20 shown in phantom.
Figure 7A:
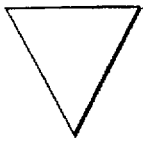
FIG. 7 illustrates an end view of sections having a shape selected from triangular (FIG. 7A) trapezoidal (FIG. 7B), and half-round (FIG. 7C).
Figure 7B:
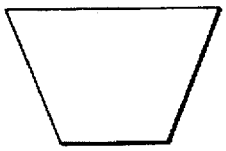
Figure 7C:
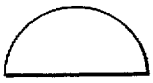

Among the core materials that are suitable for selection are copper, nickel, iron, silver, alloys thereof, graphite, aluminum nitride, and similar compounds. Alternatively, (FIG. 5) the core may be formed from a stranded construction of high thermal conductivity strands 34 proportionately mixed with strands of a high oxidation resistance alloy 36 to resist oxygen attack while the other strands promote the high thermal conductivity. The HOSKINS ALLOY 651 is a preferred core material. It has 99.3% nickel. The preferred cladding material is the HOSKINS ALLOY 831 which has 77% Ni; 14.8% Cr; 0.35% Mn; 0.35% Si; and 7.5% Fe.

The core material could be modified from a pure metal to an alloy with greater resistance to oxidation and thus loss of material by spalling from being exposed to the engine atmosphere by fusion welding the core and cladding at the electrode end as the spark plug is being manufactured.

This technique allows copper to be exposed, since fusion of the copper with the nickel alloy will produce a weld nugget of a ceopper-nickel-chromium-iron alloy. This is effective for the ground electrode. For the center electrode, it may be advisable to use a consumable electrode for welding so that the resulting exposed alloy will have good spark erosion resistance. For either electrode, the composite electrode might advantageously incorporate an inner and an outer cladding layer of dissimilar alloys where the inner layer would be selected to alloy easily with copper, resulting in an oxidation resistant alloy when fusion welded. The alloy of the outer layer provides the arc resistant surface for the ground electrode. For the center electrode, a consumable welding electrode may cap the composite electrode and provide the arc resistant surface.

When copper is used as a core, the electrode material includes a region of copper exposed at the arcing surface 24 resulting from shearing the composite electrode from a reel of the material. To reduce the potential for oxidation of the copper to spall off into the cylinder, a copper alloy can be used as the core material that has an alloying-element which can be precipitated through heat treatment, thus yielding widely dispersed particles that will oxidize preferentially to the copper base material. In this case, the core may be formed from a copper/chromium/titanium alloy or other copper alloy with limited solubility additives that can be heat treated to precipitate out the secondary phases, thus restoring the thermal conductivity of the copper while retaining the oxidation resistant characteristics of the Cr and Ti precipitates.

Since up to three times the amount of copper may be used in the composite electrode materials of the present invention as compared to traditional approaches, suitable cores may include metals and compounds that may have only ⅓ the thermal conductivity of copper. Their selection may be a suitable alternative if availability and cost considerations dictate.

Upon exposure to the operating conditions of the electrode, the cladding layer forms an adherent oxide layer that is resistant to sulfur, carbon, and other corrosive agents. Thus, the alloy is desirable because of its high temperature stability.

The disclosed material also has the potential of eliminating the need for platinum alloy tips often found in prior art electrode materials.

While various alloys may be suitable for selection as the cladding layer, a preferred metal is HOSKINS ALLOY 893, which is available from the Hoskins Manufacturing Company of Hamburg, Mich. This cladding is a combination alloy containing several additives known to initiate an adherent layer on surfaces exposed to high temperatures in an oxidizing atmosphere. Its melting point is at least as high as HOSKINS ALLOY 831 and its resistance to corrosion is much superior. Electrode materials can be supplied in solid round or rectangular wire or as nickel (or other material) cored composites in round, rectangular, and shaped forms.

If desired, the HOSKINS ALLOY 831 may comprise the cladding layer in conjunction with a ceramic core having a high thermal conductivity, which exceeds that of most metals, and in particular, aluminum nitride.

Preferably, the cladding layer 22 is formed from a nickel-based alloy with 14–15.5% Cr; 7–8% Fe; 0.2–0.5% Si; and 0.2–0.5% Mn. Such a cladding layer is especially preferred with a core of pure nickel in which the minimum nickel content is about 99.3%, with a balance of Co, Si, Ca, Mg, and Zr.

To fabricate the disclosed electrode materials, the following manufacturing steps have been followed with good results, although variants are possible:

1. Providing a rod of the core material having a diameter between 0.250–0.275 inches (0.265 inches average). The rod is then drawn to size and annealed at 1500°–1700° F. in an inert or reducing atmosphere for 5–10 minutes to yield a bright, oxide-free surface;
2. Providing strips of cladding having a thickness between 0.02–0.045 inches (preferably 0.020–0.030 inches). Before forming, the width of the strip is at least 30 times its thickness;
3. Passing these strips through tube-forming rolls to partially close the strips;
4. Introducing the core using a knife edge or seam guide which keeps the core spaced apart from the cladding;
5. Passing the partially closed strip through further tube-forming rolls to completely close the strips;
6. Welding the seam;
7. Passing the core and the cladding through reduction apparatus, for example, e.g., a drawing die (to achieve a reduction in cross-sectional area of about 20%);
8. Coiling the reduced material upon exiting the machine to assemble into coiled bundles;
9. Drawing the composite wire down to an outside diameter of about 0.250 inches;
10. Annealing at 1500°–1700° F. for 5–10 minutes;
11. Further reduction and annealing steps used to prepare various round, rectangular, or shaped sections.

Further details of the manufacturing apparatus which may be used to fabricate the disclosed electrode materials can be found in U.S. Pat. No. 5,346,116 which is assigned to the assignee of the present invention, and is incorporated here by reference.

Other materials suitable for the cladding layer are disclosed in pending U.S. patent application Ser. Nos. 08/225,964 filed Apr. 8, 1994, and 08/225,471 filed Apr. 8, 1994 which are assigned to the assignee of the present invention and are incorporated here by reference.

While the best mode for carrying out the invention has been described in detail, those familiar with the art to which this invention relates will recognize various alternative designs and embodiments for practicing the invention as defined by the following claims.

What is claimed is:

1. A spark plug for use in an internal combustion engine, the spark plug having a center electrode, a ground electrode, each electrode having a hot end and a cooler end, the cooler end being in thermal communication with the engine, a gap defined between the center and ground electrodes, and a shell, wherein at least one of the ground and center electrode includes an electrode material with:

a core having a high thermal conductivity for reducing the temperature of the spark plug by conducting heat away from the gap, the core extending continuously from an arcing surface at the hot end of the at least one of the ground and center electrodes to the cooler end of the other one of the ground and center electrodes;

at least one cladding layer consisting essentially of a metallic material selected from the group consisting of a metal, an alloy, and mixtures thereof, the cladding layer being metallurgically bonded to the core for resisting erosion when exposed to high operating temperatures of the engine and a diffusion interlayer between the cladding layer and the core, the diffusion interlayer comprising a metallurgical bond at least adjacent to the gap between the center and ground electrodes for promoting heat transfer and minimizing delamination of the cladding layer from the core.

2. The spark plug of claim 1 wherein the core comprises a metallic material.

3. The spark plug of claim 1 wherein the core is selected from a group consisting of copper, nickel, iron, silver, alloys thereof, aluminum nitride, and graphite.

4. The spark plug of claim 1 wherein the core comprises a stranded construction of high thermal conductivity strands proportionately mixed with strands of a high oxidation resistance alloy to resist oxygen attack and promote thermal conductivity.

5. The spark plug of claim 1 wherein the hot end of the at least one of the ground and side electrodes includes a cap joined to the hot end in order to provide greater resistance to oxidation and thus loss of material by spalling.

6. The spark plug of claim 5 wherein the cap comprises a copper nickel chromium iron alloy.

7. The spark plug of claim 1 wherein the core comprises up to 70% of the cross-sectional area of the at least one of the ground and center electrodes.

8. The spark plug of claim 1 wherein the cladding layer is a layer which comprises multiple sheets of cladding.

9. The spark plug of claim 8 wherein the layer comprises an inner cladding layer selected to alloy easily with copper, resulting in an oxidation-resistant alloy when fusion welded, and an outer cladding layer providing an arc-resistant surface.

10. The spark plug of claim 1 wherein the center electrode comprises a consumable welding electrode which caps the hot end thereof and provides an arc-resistant surface.

11. The spark plug of claim 1 wherein the center electrode comprises the electrode material.

12. The spark plug of claim 1 wherein the ground electrode comprises the electrode material.

13. The spark plug of claim 1 wherein the center electrode and the ground electrode are formed from the electrode material.

14. The spark plug of claim 1 wherein the at least one electrode has a circular cross-section.

15. The spark plug of claim 1 wherein the at least one electrode has a generally rectangular cross-section including rounded corners joining adjacent sides.

16. The spark plug of claim 1 wherein the electrode material has a cross-section having a shape selected from the group consisting of triangular, trapezoidal, and half-round.

17. The spark plug of claim 1 wherein the cladding layer comprises an alloy selected from the group consisting of a nickel-based alloy, a cobalt-based alloy, an iron-based alloy, and mixtures thereof.

18. The spark plug of claim 1 wherein the cladding layer consists essentially of an alloy, the core comprising a ceramic material having a high thermal conductivity approaching the thermal conductivity of pure copper while obtaining the oxidation-resistant characteristics of precipitates.

19. The spark plug of claim 1 wherein the core comprises a copper alloy including an alloying element which can be precipitated through heat treatment, thus approaching the thermal conductivity of pure copper while obtaining the oxidation resistant characteristics of the precipitates.

20. The spark plug of claim 18 wherein the core consists essentially of a copper, chromium, titanium alloy or copper alloys with limited solubility additives that can be heat-treated to precipitate out secondary phases, thus approaching the thermal conductivity of pure copper while obtaining the oxidation-resistant characteristics of the chromium and titanium precipitates.

21. A spark plug with a center electrode and a ground electrode, each having a hot end and a cooler end, the cooler end being in thermal communication with an internal combustion engine:

wherein the ground electrode has a composite electrode material with:

a core of a high thermal conductivity for reducing the temperature of the spark plug by thermally conducting heat away from a gap defined between the ground electrode and the center electrode, the core extending continuously from an arcing surface at the hot end of the ground electrode to the cooler end of the ground electrode;

a cladding layer of a metallic material surrounding and metallurgically bonding with the core for resisting erosion when exposed to high temperatures caused by arcing; and a diffusion interlayer between the cladding layer and the core, the diffusion interlayer comprising a metallurgical bond at least adjacent to the gap between the center and ground electrodes for promoting heat transfer and minimizing delamination of the cladding layer from the core.

22. The spark plug of claim 21 wherein both the ground electrode and the center electrode are manufactured from the composite electrode material.

* * * * *

UNITED STATES PATENT AND TRADEMARK OFFICE

CERTIFICATE OF CORRECTION

PATENT NO. : 5,675,209

DATED : October 7, 1997

INVENTOR(S) : BERTIE F. HALL, JR. et al.

It is certified that error appears in the above-identified patent and that said Letters Patent is hereby corrected as shown below:

Column 7, Line 10, Claim 20, delete "18" and insert --19--.

Signed and Sealed this

Thirtieth Day of March, 1999

*Attest:*

Q. TODD DICKINSON

*Attesting Officer*

*Acting Commissioner of Patents and Trademarks*